United States Patent [19]

Woods

[11] 4,014,122

[45] Mar. 29, 1977

[54] PAPERWEIGHT WITH SCREW THREADED BOTTOM CAP

[76] Inventor: Oscar J. Woods, 595 S. Mill Road, Vineland, N.J. 08360

[22] Filed: Sept. 22, 1975

[21] Appl. No.: 615,469

[52] U.S. Cl. ..... 40/358; 428/13

[51] Int. Cl.[2] ..... B43M 9/00

[58] Field of Search ..... 40/10 D, 152, 358; 215/1 R; 206/43.34; 220/82 R, 82 A; D19/96; D6/243; 428/7, 13; 63/18

[56] References Cited

UNITED STATES PATENTS

| | | | |
|---|---|---|---|
| 736,751 | 8/1903 | Lobmiller | 40/10 D |
| 1,741,692 | 12/1929 | Garaja | 428/13 |
| 2,427,870 | 9/1947 | Mitchell | 40/358 |

*Primary Examiner*—John F. Pitrelli
*Attorney, Agent, or Firm*—Clarence A. O'Brien; Harvey B. Jacobson

[57] ABSTRACT

A paperweight having a heavy, transparent glass or plastic upper portion and a screw threaded opaque bottom cap. Display photos are insertable between the transparent upper portion and the opaque cap.

2 Claims, 3 Drawing Figures

PAPERWEIGHT WITH SCREW THREADED BOTTOM CAP

BACKGROUND OF THE INVENTION

1. Field of the Invention

This invention relates generally to paperweights, and in particular to a paperweight device having a heavy, transparent upper portion, and with a screw threaded bottom cap. Display photos are insertable between the upper portion and the bottom cap by unscrewing said cap and placing the photo therein.

2. Description of the Prior Art

Numerous paperweights are known in the prior art and are of many types and descriptions. Some have provision for holding display items therein or thereon, but none have the features of this invention.

Many of the prior art devices are quite complex and difficult to manufacture. There are several prior patents that may be pertinent to the invention; Pflueger, U.S. Pat. No. 279,795, Bright, U.S. Pat. No. 683,888, and Snyder, U.S. Pat. No. 2,361,425, each show paperweights having one or another type display means associated with the paperweight. Each of these is relatively complex and expensive to manufacture. The Huntley U.S. Pat. No. 273,685 teaches display means associated with a door knob, Porrera U.S. Pat. No. 357,689 teaches display means with a glass dish, and Priestnall U.S. Pat. No. 777,305 shows similar display means in a drinking glass. None of these latter patents are for the purpose of paperweights.

SUMMARY OF THE INVENTION

An object of the present invention is to provide a paperweight which has a screw threaded bottom cap which is easily removable so that a display photo may be inserted in the paperweight.

Another object of the present invention is to provide a paperweight which is easily manufactured at a relatively small cost.

A further object of the present invention is to make a paperweight of crystal, glass, or plastic, which is transparent for the purpose of showing a display photo mounted therein to the best advantage.

A still further object of the present invention is to provide a paperweight device which can use standard production item-type caps.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE PREFERRED EMBODIMENT

Figure 1:
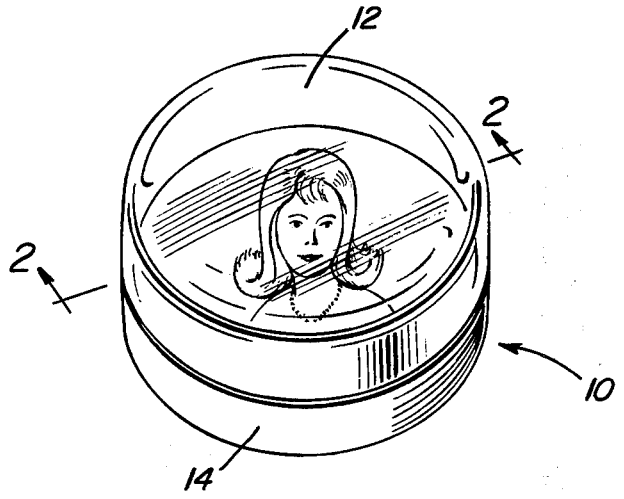
FIG. 1 is a perspective view showing the paperweight according to the present invention.

Referring now to the drawings, the paperweight of this invention is shown generally by reference numeral 10. The paperweight device has a heavy, transparent upper portion 12 made of glass, crystal, or plastic. Screw threads 13 are provided on the lower portion of the member 12. These threads are provided so that a bottom cap 14 may be firmly attached to the heavy member 12 of the paperweight.

Normally a display photo 16 will be used with the paperweight. A cushioning member 18 is also provided so that when the cap 14 is firmly screwed onto the member 12 the display photo will be in firm contact with the bottom of the transparent member 12. This eliminates any air gap and reduces distortion of the image of the display photo as viewed from the top of the paperweight.

Figure 2:
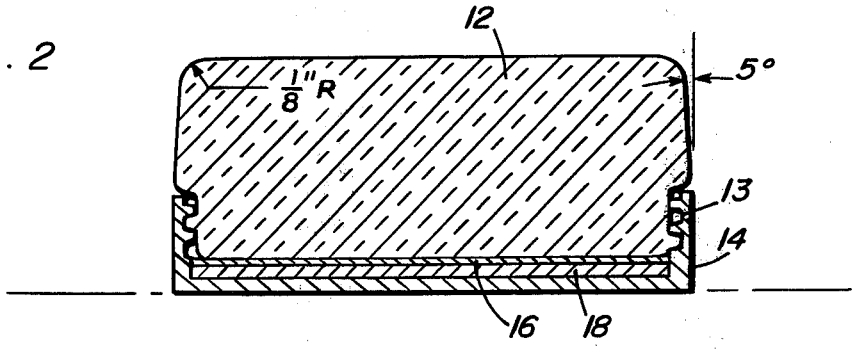
FIG. 2 is a sectional view generally along the line 2—2 of FIG. 1, but drawn to a larger scale.
Figure 3:
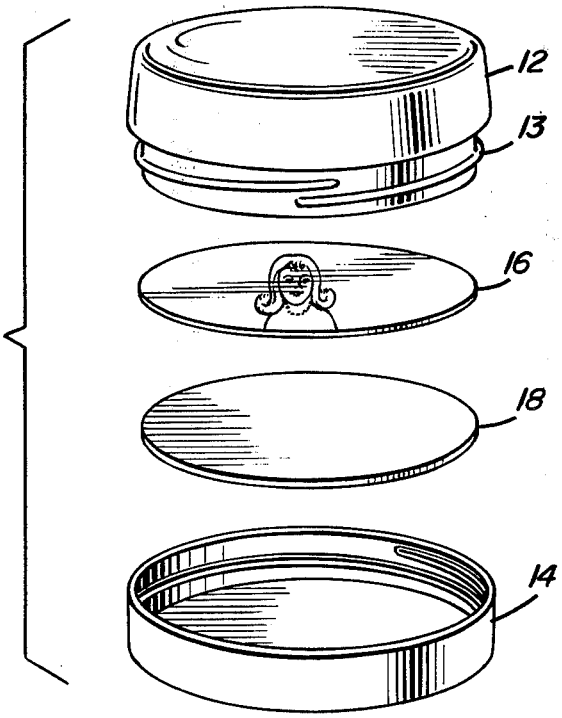
FIG. 3 is an exploded perspective view showing the element of FIG. 1.

An important feature of this invention is in the fact that the transparent member 12 is designed to be molded in one piece, and to facilitate the manufacture thereof, the upper outer side portion has a slight taper of approximately 5° from the vertical as best shown in FIG. 2. Also, the top outer edge has a radius of curvature of approximately ⅛ inch. Both of these dimensions are important to facilitate easy and inexpensive manufacture of the transparent member 12.

Another important feature of this invention is in the screw threads 13. These threads have a radius of approximately 3/64 inch, and are six per inch in depth. These threads are standardized to fit a 63 millimeter G.C.M.I. thread cap. These caps are readily available as standard production items and thus are important in keeping the cost of the over-all paperweight to a minimum.

The completed paperweight is simple, yet highly functional, easily manufactured at a minimum of cost, and lacks the complexity of many prior paperweights.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A paperweight device having a heavy, round in circumference, flat topped, transparent upper portion, a separable lower portion with means for securing the two portions together, the means for securing the two portions together are screw threads of 3/64 inch radius and 6 per inch, the separable lower portion is a standard production 63 millimeter G.C.M.I. thread cap, the upper outer side of the transparent upper portion have a 5° taper from the vertical towards the center of the portion and the upper edge having a corner of ⅛ inch radius, together with a display photo between the transparent upper portion and the lower cap, and cushioning means between the display photo and the lower cap to eliminate air space and distortion of the photo image from the top of the device when the cap is firmly screwed onto the transparent upper portion.

2. The device as defined in claim 1, wherein the cushioning means between the display photo and the lower cap to eliminate air space and distortion of the image of the display photo as viewed from the top of the paperweight includes a cushioning member of round shape having a circumference just slightly smaller than the inner circumference of the lower cap and being solid throughout without any apertures therein.

* * * * *